US007121353B2

(12) United States Patent
Setzer

(10) Patent No.: US 7,121,353 B2
(45) Date of Patent: Oct. 17, 2006

(54) AIRBORNE VEHICLE FOR FIREFIGHTING

(75) Inventor: Uwe Setzer, Frickingen (DE)

(73) Assignee: Bodenseewerk Gerätetechnik GmbH, Überlinger (DE)

( * ) Notice: Subject to any disclaimer, the term of this patent is extended or adjusted under 35 U.S.C. 154(b) by 110 days.

(21) Appl. No.: 10/951,135

(22) Filed: Sep. 27, 2004

(65) Prior Publication Data

US 2006/0005974 A1 Jan. 12, 2006

(30) Foreign Application Priority Data

Oct. 4, 2003 (DE) ..... 103 46 163

(51) Int. Cl.

| | |
|---|---|
| ***A62C 35/02*** | (2006.01) |
| ***A62C 25/00*** | (2006.01) |
| ***A62C 27/00*** | (2006.01) |
| ***A62C 29/00*** | (2006.01) |
| ***A62C 37/00*** | (2006.01) |

(52) U.S. Cl. ..... 169/28; 169/53; 169/56; 169/58; 169/60; 102/367; 244/3.15; 244/3.16

(58) Field of Classification Search ..... 169/28, 169/53, 56, 58, 60, 24, 30, 36, 52, 54, 61, 169/72, 91; 89/1.55, 1.57; 102/367, 368, 102/369, 370, 396, 397; 244/3.15, 3.16
See application file for complete search history.

(56) References Cited

U.S. PATENT DOCUMENTS

| | | | | |
|---|---|---|---|---|
| 1,903,348 | A * | 4/1933 | Anderson | 102/369 |
| 2,091,589 | A * | 8/1937 | Finzi | 169/28 |
| 2,306,321 | A * | 12/1942 | Roberts | 244/136 |
| 2,349,980 | A * | 5/1944 | Moore | 102/382 |
| 2,633,920 | A * | 4/1953 | Carlson | 169/33 |
| 2,665,768 | A * | 1/1954 | Talbot | 169/36 |
| 2,703,527 | A * | 3/1955 | Hansen | 102/365 |
| 3,382,800 | A * | 5/1968 | Biggs, Jr. | 102/369 |
| 3,833,063 | A * | 9/1974 | Williams | 169/28 |
| 3,833,064 | A * | 9/1974 | Ranney, Jr. | 169/52 |
| 3,980,139 | A | 9/1976 | Kirk | |
| 4,285,403 | A * | 8/1981 | Poland | 169/28 |
| 4,964,469 | A * | 10/1990 | Smith | 169/28 |
| 6,179,246 | B1 * | 1/2001 | Fisel et al. | 244/3.16 |
| 6,318,473 | B1 * | 11/2001 | Bartley et al. | 169/26 |
| 6,470,805 | B1 * | 10/2002 | Woodall et al. | 102/370 |
| 6,919,840 | B1 * | 7/2005 | Friedrich et al. | 342/68 |

FOREIGN PATENT DOCUMENTS

| | | |
|---|---|---|
| DE | 71304763 | 1/1973 |
| DE | 44 28 300 A1 | 8/1994 |
| DE | 195 00 477 C1 | 1/1995 |
| DE | 196 01 282 C1 | 1/1996 |
| DE | 198 25 614 A1 | 8/1998 |
| FR | 1.473.621 | 3/1966 |
| WO | WO 97/06858 | 8/1996 |
| WO | WO 03/004102 A1 | 7/2002 |

* cited by examiner

*Primary Examiner*—David A. Scherbel
*Assistant Examiner*—Darren Gorman
(74) *Attorney, Agent, or Firm*—Scully, Scott, Murphy & Presser

(57) ABSTRACT

An airborne vehicle (1, 2, 10) which is equipped with an extinguishant container (12) for mist extinguishing is specified for efficient firefighting. A detonator (18) which is located on the extinguishant container (12) can be detonated via a fuze (19). The detonator (18) is attached to the airborne vehicle (1, 2, 10) such that, on firing the extinguishant which is contained in the extinguishant container (12) produces an extinguishant mist.

14 Claims, 4 Drawing Sheets

AIRBORNE VEHICLE FOR FIREFIGHTING

BACKGROUND OF THE INVENTION

1. Field of the Invention

The invention relates to an airborne vehicle for firefighting, which possesses an extinguishant container, a detonator, and a fuze.

2. Discussion of the Prior Art

U.S. Pat. No. 3,980,139 and FR 1 473 621 disclose a so-called fire extinguishing bomb as an airborne vehicle of the type mentioned initially for firefighting, which comprises a cylindrical gas or plastic container for holding an extinguisher, and an inner container which is arranged concentrically in it, for holding a detonator. The detonator is in this case fired by the external influence of the heat produced by a fire. This has the disadvantage that the extinguishant is not distributed uniformly if the environmental topology is poor. While the flames are extinguished at some points, the fire has time at other points to propagate even more strongly and, possibly, to cause areas that have already been extinguished to burn once again. In the worst case, the fire is fanned out, spread by a certain amount of the extinguishant striking an object whose position is thus changed, and thus itself now causes other objects to burn.

DE 195 00 477 C1 discloses a method and an apparatus for extinguishing forest fires or fires over a larger area. In this case, flexible hoses which are filled with an extinguishant, can be closed at their ends and are provided with a detonator are deployed in front of a fire front. The extinguishant mist is produced by firing the detonator. This results in the periphery of the fire being fought. This means that the outer boundary areas of a burning region can be extinguished, provided that the firefighters can reach them without being endangered. Efficient firefighting is impossible. Those areas which are already burning can be prevented from propagating further, that is to say they can be constrained. However, what is already in flames is generally subject to the destructive effect of the fire until it is completely destroyed, and can no longer be rescued.

SUMMARY OF THE INVENTION

The present invention is based on the technical problem of providing an airborne vehicle which allows efficient firefighting with an area effect that is greater than that in the prior art.

For an airborne vehicle of the type mentioned initially, the object is achieved according to the invention in that an airborne vehicle which is equipped with an extinguishant container is used for firefighting, with the extinguishant container having a detonator arranged on it such that, when the detonator is detonated by means of a fuze, an extinguishant which is contained in the extinguishant container is released in the form of mist.

A first step of the invention is based on the discovery that the mist extinguishing method represents an efficient option for firefighting. Mist has a greater extinguishing effect than liquid. Since a relatively large amount of mist can be produced from a small amount of liquid, an extinguishant container for mist extinguishing need contain only a small amount of liquid, in comparison to a fire extinguishing bomb.

A further step of the invention is now based on the idea that only a limited amount of the extinguishant can be transported in an airborne vehicle. Application of the mist extinguishing method to the extinguishant which is transported by the airborne vehicle thus results in an improvement in the efficiency of firefighting in comparison to the previous fire extinguishing bombs, in which large amounts of the extinguishant are distributed in an uncontrolled manner.

The invention allows the extinguishant to be conveyed to the location that is suitable for efficient firefighting, where the extinguishant is released in a defined manner over a large area in the form of mist, as a result of which the fire is quickly and efficiently extinguished.

In this context, the word mist means a relatively homogeneous mixture of gas and liquid which generally has a liquid droplet size of not more than 0.1 mm. The small size of the droplets in the mist results in a major cooling effect, since a large amount of heat bonding is produced. In contrast to liquid, this also results in bonding with hazardous substances and smoke. Furthermore, mist extinguishing results in more efficient oxygen displacement than liquid extinguishing. This improves the extinguishing effect, and allows a fire to be confined more quickly.

The behaviour of the fire is such that, if the mist droplets are too far away from the fire, the mist droplets are braked to a major extent by the air before reaching the fire. Furthermore, external influences such as the wind, can cause the mist front to be blown away from the actual central fire area. When an airborne vehicle is used, the mist can be produced at a suitable height above the fire, and its positive extinguishant effect can be developed optimally with respect to heat, hazardous substance bonding, smoke bonding, as well as oxygen displacement.

For the purposes of the application, the expression airborne vehicle means any object which can be ejected or fired from an aircraft or from a mobile or stationary launch device. The airborne vehicle may have no propulsion system or may be equipped with its own propulsion system, for example a propeller, or a propulsion system based on the reaction principle, etc.

Since the extinguishant container for mist extinguishing is integrated in an airborne vehicle, an extinguishant mist can be produced in the central area of a fire, for efficient firefighting. The distance from the fire which must be complied with in the case of extinguishant containers which are designed to be deployed on the basis of the development of heat can be overcome by the airborne vehicle being fired, for example from an aircraft or from a launch device, into the central area of the fire, or being ejected onto this central area of the fire. This prevents any danger to the firefighters and physical damage to the aircraft or launch device as a result of blowing away from the fire, because it is possible to choose greater distances from the fire.

If a launch device is used to launch the airborne vehicle, this launch device may have sensor means, for example infrared laser or radar, in order to aim the airborne vehicle at the location of the fire. Launch devices such as these are known from DE 196 01 282 C1 and from DE 198 25 614 A1.

In one development of the invention, a bag which is filled with extinguishant and is surrounded by a grating structure is advantageously used as the extinguishant container. The material of the bag should on the one hand have a certain amount of strength, but on the other hand should be capable of bursting when detonated. By way of example, a thin-walled plastic film with good resistance is suitable as the material. The grating structure may, for example, be a metallic mesh wire. This allows the bag to be transported without being damaged, while nevertheless allowing the mist that is generated to pass through the meshes. The materials for the bag and grating structure should ideally also have a low intrinsic weight, in order to make is possible to produce an airborne vehicle which is as light as possible. This allows, for example, a greater number of airborne vehicles to be transported by one aircraft, owing to the reduced weight. The bag may be filled with extinguishant in advance, and, for example, may be sealed by weld beads. Alternatively, the bag may also be provided with a closable filling nozzle, in order to allow the bag to be filled with the most suitable extinguishant depending on the nature of the fire or the burning material in any given situation. In this case, the grating structure ideally has a facility for the filling nozzle to pass through. If different substances are burning in the case of a fire in a chemical factory, then these often cannot be extinguished by means of the same extinguishant. The option to fill the bag via a filling nozzle now creates the capability to fill the bag with the appropriate extinguishants.

The detonator is expediently in the form of a detonating cord, which runs in the longitudinal direction of the extinguishant container. This ensures that the bag filled with extinguishant bursts completely, and that the homogenous mist is produced. In this case, the bag is designed in a skilful manner as a cylindrical roller with a concentric inner aperture. The detonating cord can then be pulled through this inner aperture in order to ensure that the bag bursts open over its entire length.

In another preferred variant, the detonator is in the form of discrete explosive charges, which are arranged at defined intervals on the extinguishant container. In this case, it is sensible to attach the explosive charges to the bag or extinguishant container such that the bag bursts open completely, resulting in a homogeneous mist front over a large area.

The airborne vehicle is preferably equipped with a time fuze, in order that the extinguishant container is detonated, and the mist production associated with this is produced at a suitable distance from the location of the fire in order to achieve a particularly good extinguishing effect. In this case, it is sensible to preset time for the time fuze which can be determined from the airborne vehicle speed and the distance between the airborne vehicle and the fire. This ensures that the extinguishant mist is generated over the central area of the fire, and within range of the mist.

In a further advantageous variant, the airborne vehicle is provided with a radio fuze, so that the detonator can be fired via a remote control visually on reaching the fire and the required altitude. This allows the firefighter to initiate the generation of the extinguishant mist from a safe distance away from the fire, without any danger to him. This also skillfully means that the distance that the firefighter must keep away from the fire owing to the heat radiation is no longer an insurmountable obstruction.

The extinguishant container is expediently designed such that further expedient containers can be coupled to it, in order to allow one airborne vehicle to transport the amount of extinguishant required depending on the size and intensity of the fire to be fought. With this configuration, the length of the airborne vehicle grows as the function of the number of extinguishant containers arranged directly one behind the other, without any gap. Since the grating structures which surround the bag filled with extinguishant can be anchored to one another, the amount of extinguishant transported by a single airborne vehicle can be multiplied. For example, in the case of large-area fires, it is thus possible to quickly and effectively suppress further, rapid propagation of the burning area. With this modular configuration, it is sensible for the detonator to pass through all of the extinguishant containers, so that all of the extinguishant containers can be detonated using a single fuze.

The airborne vehicle is preferably provided with vanes which stabilize flight. The vanes may extend along the complete length of the airborne vehicle, or on a sub-area of it. The vanes improve the flight characteristics of the airborne vehicle and allow the desired flightpath to be maintained better. The airborne vehicle is thus insensitive to wind gusts. This not only makes it easier to reach the actual central fire area, but effectively assists the process.

The airborne vehicle expediently has its own propulsion system for continued movement. An engine contained in the airborne vehicle makes the airborne vehicle independent of weather-dependent thermal conditions. Because the airborne vehicle has its own propulsion system, wind or precipitation cannot move it away from a flightpath aimed at the fire. Danger to the firefighters and to the firing or launching devices caused by the fire can be precluded since safety distances from the fire may be in the range of kilometres, since these distances can be overcome without any problems by an airborne vehicle with its own propulsion system and, so to speak, the airborne vehicle takes itself to the target, that is to say to the central fire area. Since an airborne vehicle with its own propulsion system is generally able to carry out escape manoeuvres as well, obstructions in the area of the flightpath of the airborne vehicle are irrelevant. Thus, even regions where access is difficult owing to geographic conditions, for example mountainous regions, can be extinguished quickly and specifically in the event of a fire.

Furthermore it is advantageous to provide the airborne vehicle with a sensor and an initiation unit, via which the fuze can be initiated as a function of a signal from the sensor. This detonation of the extinguishant container, which can be initiated externally by means of the initiation unit without any human action, means that poor visual conditions, caused either by the weather or by the amount of smoke that is being developed, are irrelevant. Bad human decisions, which lead to the detonator being fired too early or too late, and result in fires not being extinguished or the boundary areas of fires being extinguished locally, and thus senseless loss of a valuable airborne vehicle, are thus completed precluded. The use of a sensor signal to define the firing time results in an increase in the extinguishing effectiveness since the sensor signal provides an "on-site estimate" of the actual fire situation.

The initiation unit is advantageously connected to a height sensor, via which the height above a fire can be determined. When a defined distance, which corresponds to a specific signal from the height sensor, is reached, then the detonator is advantageously fired automatically by means of the signal value that is transmitted to the initiation unit. The defined distance is in this case skilfully a distance which is within the area covered by the range of the extinguishant mist, in order to achieve effective mist extinguishing.

Another advantage is created by the connection of the initiation unit to an infrared or heat sensor, by means of which the temperature of objects and/or of a background can be determined. If the temperature detected by means of the infrared or heat sensor exceeds a specific threshold value, the firing is initiated automatically via the initiation unit. Initiation of the detonation only at high temperatures via the initiation unit avoids the extinguishant mist from being wasted senselessly in fire areas which can also be extinguished by simpler extinguishant devices. Fires can also be fought at locations at which the fire is raging particularly severely, and where there is a risk of the source of a fire becoming larger.

A version which is not as effective but whose cost is low is obtained by equipping the airborne vehicle with a sensor via which the firing of the detonator by the initiation unit can be initiated when the airborne vehicle strikes an object or strikes the ground.

The airborne vehicle expediently has a guidance unit for flight control. By way of example, the guidance unit has elevators and rudders, which it uses to control the flight of the airborne vehicle. The elevators and rudders may be arranged in the tail area of the airborne vehicle. In order to make it possible to exploit the advantages of a guidance unit particularly well, such a guidance unit is generally provided in airborne vehicles which have their own propulsion system. A steerable airborne vehicle is extremely worthwhile, particularly when using the airborne vehicle for attacking fires in regions where the access is topographically poor. This avoids the airborne vehicle being damaged by collisions with objects before reaching the actual source of the fire. In this case, it is possible to provide for the guidance unit to be adjustable by remote control, by radio. The guidance unit then makes it possible for the firefighter to steer relatively accurately to a fire, on the basis of an active influence. This allows the fire to be brought under control particularly quickly.

The airborne vehicle advantageously has a control unit, which is connected to the guidance unit and is connected to means for target searching. In this case, the guidance unit is controlled via the control unit towards the targets on the basis of the signal from the means for target searching. In the case of a fire on an oil drilling platform, for example, the firefighter cannot approach within several kilometres of the central fire area on marine vessels or aircraft, owing to the extreme amount of heat and the hazardous smoke that have developed. It is impossible to control the airborne vehicle via a line of sight link into the fire. However, this problem can be overcome by the combination of a control unit with a guidance unit, in conjunction with target-searching means. This results in a guided airborne vehicle, which can fly to a target automatically without any further human action being required after the guided airborne vehicle has been launched or fired.

A global positioning system, GPS, is advantageously used as the means for target searching. The airborne vehicle which can be guided can be flown automatically to the target without any external intervention by means of its GPS, on the basis of the target coordinates which are predetermined as fixed before the airborne vehicle is launched or fired. This ensures not only that the source of the fire is reached, but also that the firefighters are protected. An airborne vehicle such as this can also otherwise be used for firefighting in inaccessible regions, such as ravines, valleys, steep slopes or mountains, where fires can be effectively extinguished by means of mist extinguishing. In order to utilize the GPS in an appropriately worthwhile manner, the airborne vehicle equipped with a GPS generally also has its own propulsion system.

Another advantage is the use of an infrared detector for target searching, on which an object scene can be imaged via optics. In this case, the signals received via the infrared detector are transmitted via the control unit to the guidance unit in order to aim the airborne vehicle at the fire. The infrared detector ensures that the airborne vehicle is always steered in the direction of the highest temperature, and thus in the direction of the fire. In order to allow effective target searching to be carried out, it is practical for the airborne vehicle to be equipped with its own propulsion system. The airborne vehicle finds the central fire area autonomously, irrespective of the visual conditions. Those areas which are most strongly affected by the fire can thus be brought under control and protected safely and quickly by extinguishing with a homogenous extinguishant mist.

The airborne vehicle may also be equipped with a braking parachute. This damps the impact of the airborne vehicle on the ground, thus protecting the components of the airborne vehicle against being damaged. This allows the components of the airborne vehicle to be reused and, in the best case, allows the airborne vehicle to be used once again after refitting it with extinguishant containers.

The reduction in the airborne vehicle speed caused by the braking parachute also allows the initiation time for a radio fuze which can be initiated remotely to be determined more accurately.

For financial reasons, the airborne vehicle may have impact protection means which are activated shortly before or after the firing of the explosive, in order to protect components, such as the initiation unit, the height sensor, the infrared or heat sensor, the guidance unit, the control unit and the target-searching means against damage and destruction when the airborne vehicle strikes the ground or an object, and to allow the possibility of reuse. The impact protection means may be pivoting metal plates, which are moved in front of the components to be protected, before impact.

In order to allow the airborne vehicle to be used with different aircraft and/or on different launch devices, the airborne vehicle ideally has suitable holders or adaptors.

BRIEF DESCRIPTION OF THE DRAWINGS

Exemplary embodiments of the invention will be explained in more detail with reference to a drawing, in which.

DETAILED DESCRIPTION OF THE INVENTION

Identical parts are in this case annotated by the same reference symbols.

Figure 1:
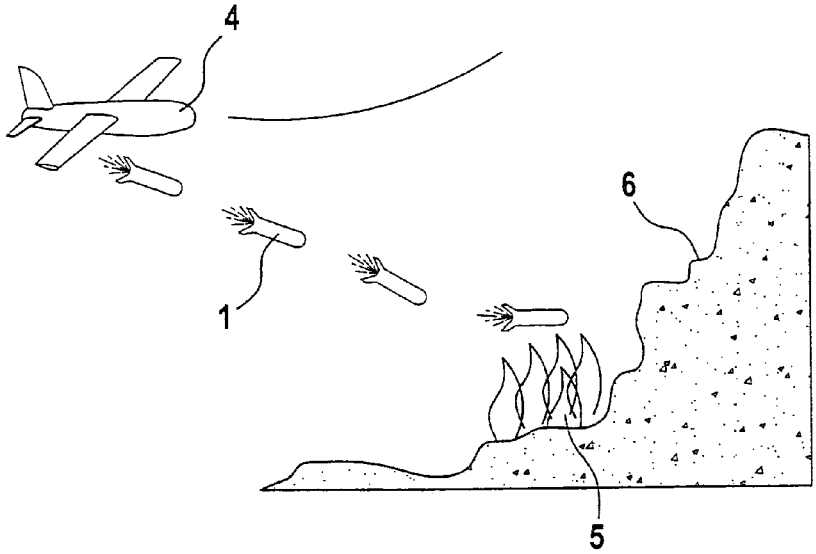
FIG. 1 shows the firing of an airborne vehicle from an aircraft.

FIG. 1 shows the firing of an airborne vehicle 1 from an aircraft 4. The airborne vehicle 1 has its own propulsion system, as can be seen from the exhaust gas jet that is illustrated. After firing, the aircraft 4 remains at a relatively long safety distance from the fire 5, since the airborne vehicle 1 is able, by virtue of its propulsion system, to travel over relatively long distances itself. Although the fire 5 is located at the edge of a mountain range 6, this allows firefighting capabilities.

The aircraft 4 can turn away safely before it reaches the mountain range 6.

Figure 2:
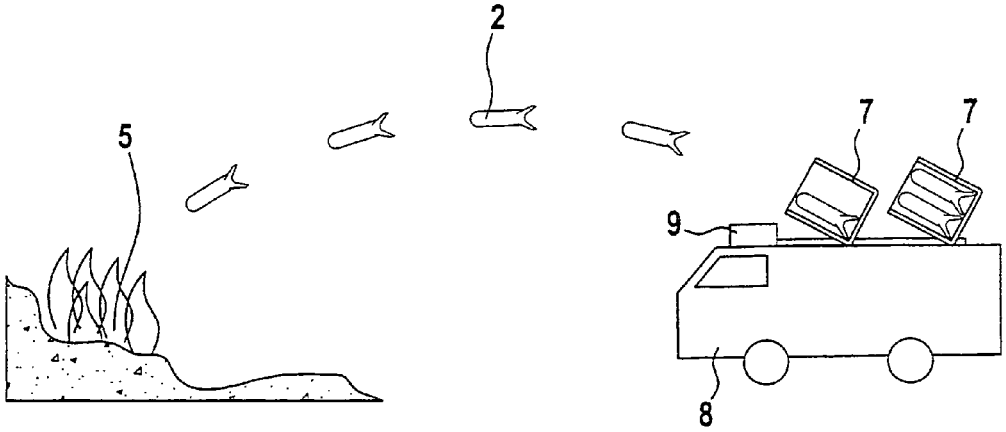
FIG. 2 shows the launching of an airborne vehicle by means of a launch device.

FIG. 2 shows an airborne vehicle 2 without its own propulsion system being launched from a launch device 7. The launch device 7 is fitted to an extinguishing vehicle 8 and is aimed at the fire 5 by means of a sensor system 9 that is connected to the launch device 7, such that the flightpath of the airborne vehicle 2 ends in the area of the fire 5. The sensor system 9 may be an infrared, laser or radar sensor system.

Figure 3:
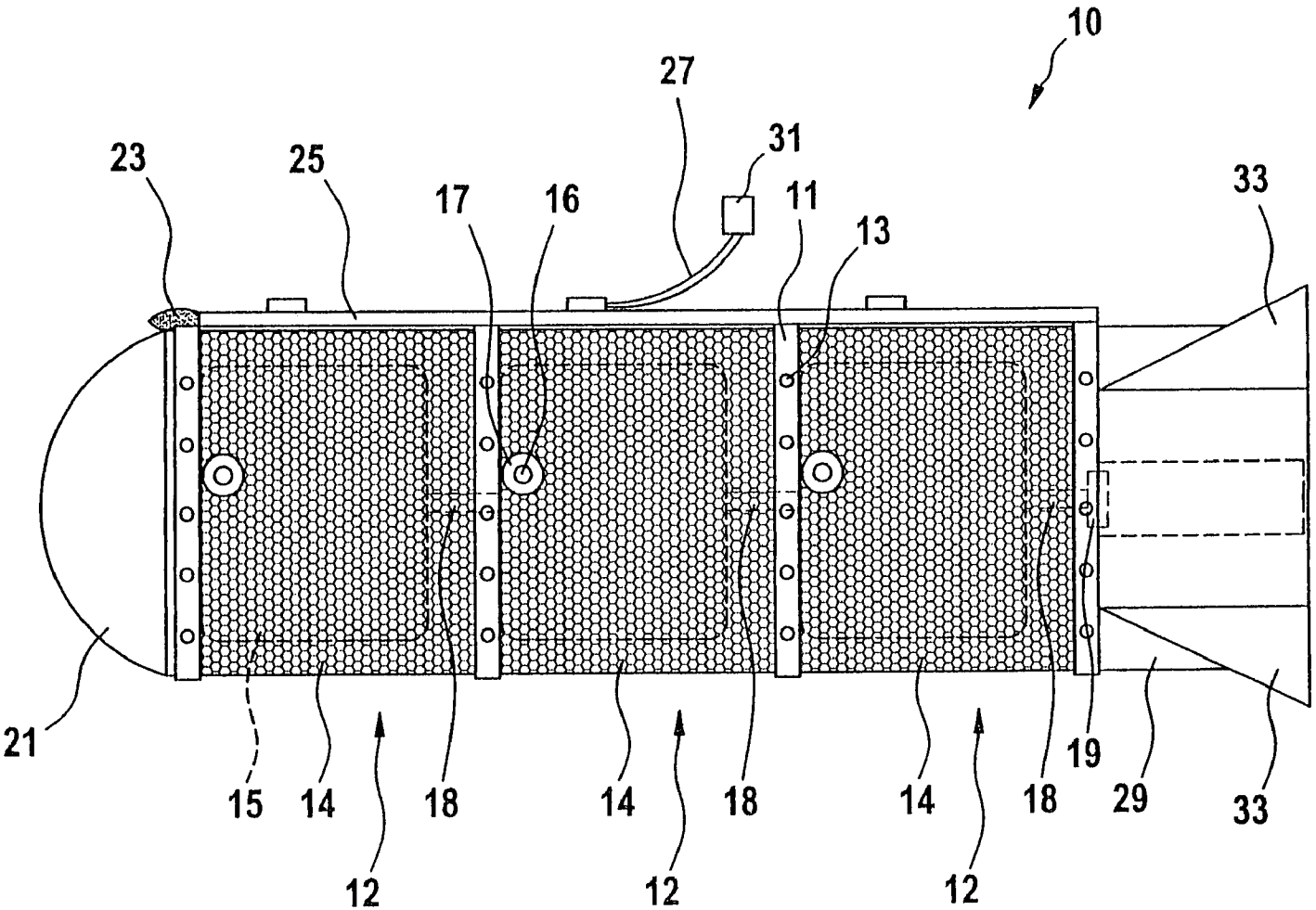
FIG. 3 shows, schematically, the configuration of an airborne vehicle with a number of extinguishant containers based on a modular configuration.

FIG. 3 shows, schematically, the design of a modular configuration airborne vehicle 10. The illustrated airborne vehicle 10 has three extinguishant containers 12. Each of the extinguishant containers 12 is formed from a grating structure 14 composed of coarse wire mesh, and an essentially cylindrical bag 15 that is filled with extinguishant and has a concentric internal aperture which cannot be seen here. A cutout 17 is provided in the grating structure 14, for a filling nozzle 16 that is located on the bag 15 to pass through. The detonator 18, in this case a detonating cord, is passed through the inner aperture. When the airborne vehicle 10 is composed of two or more modules (extinguishant containers 12), the detonators 18 of all of the extinguishant containers 12 are connected to one another, and can thus be activated by means of a single fuze 19. The fuze 19 may be a radio fuze or a time fuze. At their front end, the extinguishant containers 12 have a frame 11 with through-holes, and, at their rear end, have a frame with an external diameter which is smaller than that of the front frame, and with push-in nuts located in it. This allows the extinguishant containers 12 to be pushed one inside the other and to be connected to one another by means of bolts 13 which are passed through the through-holes and are screwed into the push-in nuts. The front area 21 and the tail area 29 of the airborne vehicle 10 can also be mounted in the same way on the front end and rear end, respectively, of the extinguishant containers 12. Other assembly and connecting techniques, such as welding, riveting or adhesive bonding, may also, of course, be used. A sensor 23 is arranged in the front area 21 of the airborne vehicle 10 and is connected to an initiation unit, which is not illustrated but which activates the fuze 19. The sensor 23 may be a height sensor, an infrared sensor or a heat sensor. A holding rail 25 runs along the airborne vehicle 10, in which a cable duct (which cannot be seen here) with cables 27 is integrated. The front area 21 is electronically connected to the rear area 29 of the airborne vehicle 10 via the cables 27. Contact can be made between the airborne vehicle 10 and an aircraft or a launch device via an interface 31. Control surfaces or vanes 33 to improve the flight characteristics are located in the tail area 29 of the airborne vehicle 10.

Figure 4:
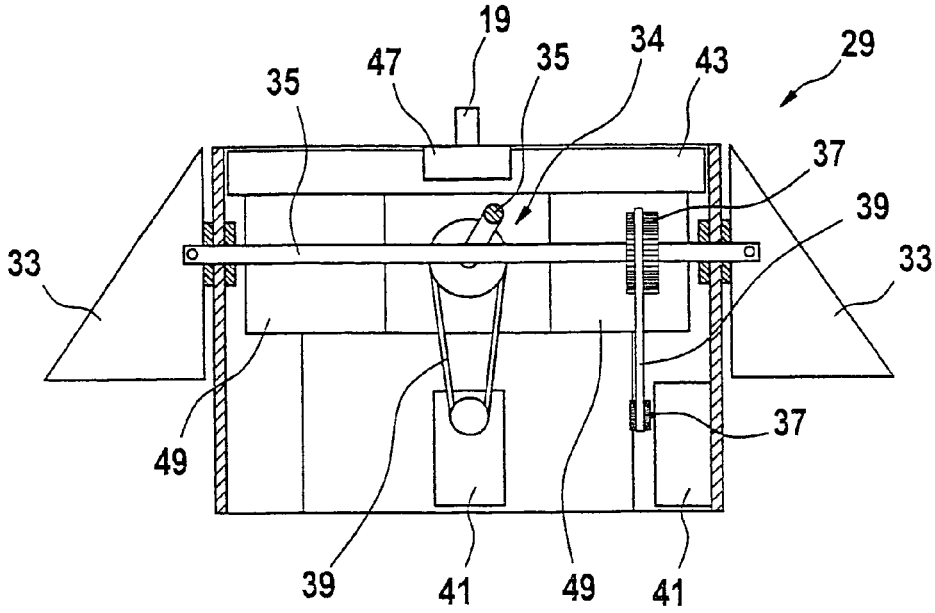
FIG. 4 shows, schematically, a longitudinal section through the tail area of the airborne vehicle shown in FIG. 3.

FIG. 4 shows a longitudinal section through the tail area 29 of the airborne vehicle 10. A guidance unit 34 with a guidance or control linkage 35, gear wheels 37, toothed belts 39 and a transmission with actuating motors or control surface motors 41 can be seen in the tail area 29, for alignment of the vanes 33. The guidance unit 34 is adjusted via an electronic control unit 43. The electronic control unit 43 is in this case connected to a GPS 45 (see FIG. 5). Before the airborne vehicle 10 is fired or launched, the target coordinates of the central area of the fire are entered in the GPS 45. The information which is received via the GPS 45 during the flight is transmitted to the control unit 43, which in turn passes on information to the guidance unit 34 for alignment of the vanes 33. Once it has been fired or launched, the airborne vehicle 10 thus flies to the target autonomously. In practice, the GPS 45 is, for better protection, arranged in the tail area 29 rather than in the front area 21 of the airborne vehicle 10, so that it is not severely damaged when the airborne vehicle 10 strikes obstructions or the ground. The tail area 29 likewise contains the initiation unit 47, which activates the fuze 19 and causes detonation of the detonator 18. The tail area 29 furthermore contains batteries 49 for supplying the current and voltage to all of the electronics in the airborne vehicle.

Figure 5:
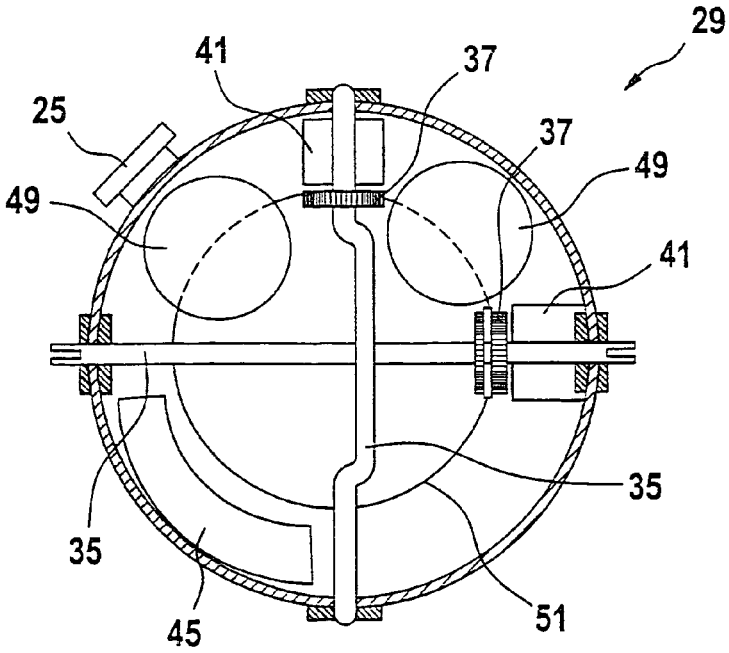
FIG. 5 shows, schematically, a cross section through the tail area shown in FIG. 4.

FIG. 5 shows a cross section through the illustrated tail area 29 of the airborne vehicle 10. A braking parachute 51, which is located in a container and can be activated before or after the firing of the detonator 18, ensures that the airborne vehicle 10 is slowed down before it strikes the ground.

Figure 6:
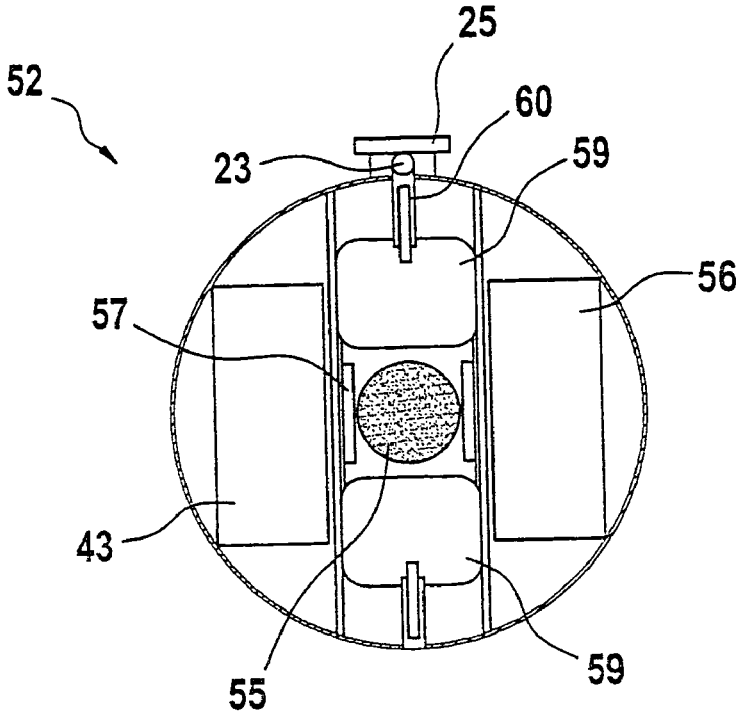
FIG. 6 shows, schematically, a cross section through a front area of an airborne vehicle.
Figure 7:
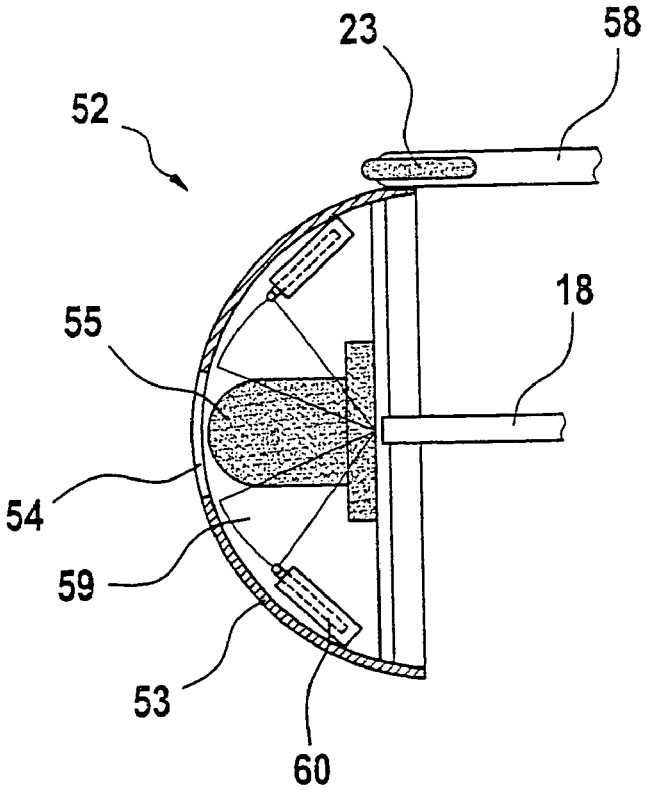
FIG. 7 shows, schematically, a longitudinal section through the front area as shown in FIG. 6.

FIG. 6 shows a cross section, and FIG. 7 a longitudinal section, through the front area 52 of another airborne vehicle. The airborne vehicle is equipped with a curved covering shroud 53 in the front area 52. An infrared detector 55, including imaging optics, is arranged under the covering shroud 53 as the target searching means, and is connected to the control unit 56, which is likewise located there. The control unit 56 supplies the information for alignment of a guidance unit in the tail area of the airborne vehicle. In this case, and apart from this in the case of the airborne vehicle 10, it is possible for an initiation unit and a fuze to be located in the front area 52 of the airborne vehicle. The majority of the curved covering shroud 53 is composed of a hard material which is insensitive to impact, for example metal, and is designed to be solid, in order to offer adequate protection. An insert 54 which is composed of a different material and is transparent for infrared radiation is located in the covering shroud 53. Solid shock absorbers 57 are arranged as impact protection means along the infrared detector 55 and its optics, with plates 59 which can pivot and are composed, for example, of metal being arranged in front of them. The plates 59 can be activated by means of an initiation mechanism 60, which is coupled to an initiation unit that cannot be seen here. This ensures adequate protection against damage when the airborne vehicle strikes the ground. An airborne vehicle such as this is aimed at its target by means of its infrared sensor system, that is to say it is aimed at the central area of a fire. The information that is determined via the infrared detector 55 is transmitted to the control unit 56, where it is further processed, and is passed on from there via a cable duct 58 to a guidance unit in the tail area, for vane alignment.

The invention claimed is:

1. Airborne vehicle (1, 2, 10) for firefighting having an extinguishant container (12), a detonator (18) and a fuze (19), wherein the detonator (18) is attached to the extinguishant container (12) such that, when the fuze (19) is initiated, an extinguishant which is located in the extinguishant container (12) is released in the form of a mist, the extinguishant container (12) has a grating structure (14) which surrounds a bag (15) which is filled with the extinguishant, the detonator (18) is in the form of a detonating cord, and is arranged in the longitudinal direction of the extinguishant container (12).

2. Airborne vehicle (1, 2, 10) for firefighting having an extinguishant container (12), a detonator (18) and a fuze (19), wherein the detonator (18) is attached to the extinguishant container (12) such that, when the fuze (19) is initiated, an extinguishant which is located in the extinguishant container (12) is released in the form of a mist, the extinguishant container (12) has a grating structure (14) which surrounds a bag (15) which is filled with the extinguishant, and the detonator (18) is in the form of discrete explosive charges which are arranged at defined intervals in the longitudinal direction of the extinguishant container.

3. Airborne vehicle (1, 2, 10) according to claim 1 or 2, wherein the fuze (19) is a time fuze.

4. Airborne vehicle (1, 2, 10) according to claim 1 or 2, wherein the fuze (19) is a radio fuze.

5. Airborne vehicle (1, 2, 10) according to claim 1 or 2, wherein the extinguishant container (12) is couplable to further extinguishant containers (12).

6. Airborne vehicle (1, 2, 10) according to claim 1 or 2, wherein said vehicle has vanes (33) formed thereon, which stabilize the flight of said vehicle.

7. Airborne vehicle (1, 2, 10) according to claim 1 or 2, wherein said vehicle is equipped with a self-contained propulsion system for continued movement of said vehicle.

8. Airborne vehicle (1, 2, 10) according to claim 1 or 2, wherein there is provided an initiation unit (47) and a sensor (23), the fuze (19) being initiatable by the initiation unit (47) as a function of a signal received from the sensor (23).

9. Airborne vehicle (1, 2, 10) according to claim 8, wherein the sensor (23) is an altitude sensor, through which there is determined the height of the vehicle above a fire.

10. Airborne vehicle (1, 2, 10) according to claim 8, wherein the sensor (23) is an infrared or heat sensor, via which the temperature of a fire is determined.

11. Airborne vehicle (1, 2, 10) according to claim 1 or 2, wherein said vehicle includes a guidance unit (34) for flight control.

12. Airborne vehicle (1, 2, 10) according to claim 11, wherein the guidance unit (34) is connected to a control unit (43, 56), which is connected to means for target searching.

13. Airborne vehicle (1, 2, 10) according to claim 12, wherein the means for target searching is a global positioning system (45).

14. Airborne vehicle (1, 2, 10) according to claim 12, wherein the means for target searching is an infrared detector (55) on which an object scene is imaged via optics.

* * * * *